United States Patent [19]

Derichs

[11] Patent Number: 4,637,207

[45] Date of Patent: Jan. 20, 1987

[54] PNEUMATIC SPINNING METHOD AND PNEUMATIC SPINNING DEVICE

[75] Inventor: Josef Derichs, Monchen-Gladbach, Fed. Rep. of Germany

[73] Assignee: W. Schlafhorst & Co., Moenchengladbach, Fed. Rep. of Germany

[21] Appl. No.: 735,075

[22] Filed: May 16, 1985

[30] Foreign Application Priority Data

May 17, 1984 [DE] Fed. Rep. of Germany ..... 3418322

[51] Int. Cl.[4] ..... D02G 1/16; D02G 3/22

[52] U.S. Cl. ..... 57/282; 57/6; 57/333

[58] Field of Search ..... 57/284, 290, 333, 6, 57/282, 308, 351

[56] References Cited

U.S. PATENT DOCUMENTS

| | | | |
|---|---|---|---|
| 3,093,955 | 6/1963 | Cadario | 57/282 |
| 3,153,891 | 10/1964 | Kissler | 57/282 |
| 3,376,698 | 4/1968 | Whittaker et al. | 57/282 |
| 3,583,140 | 6/1971 | Lorenz et al. | 57/333 X |
| 3,650,103 | 3/1972 | Farrar et al. | 57/333 X |
| 3,699,759 | 10/1972 | Lefebvre | 57/333 X |
| 3,840,630 | 10/1974 | Yamada et al. | 57/333 X |

*Primary Examiner*—Donald Watkins

*Attorney, Agent, or Firm*—Herbert L. Lerner; Laurence A. Greenberg

[57] ABSTRACT

A pneumatic spinning method includes conducting sliver formed at least partly of spinning fibers through at least one swirl nozzle, and contacting the sliver in the swirl nozzle with at least one heated compressed air jet operating the swirl nozzle, and a device for carrying out the method.

8 Claims, 4 Drawing Figures

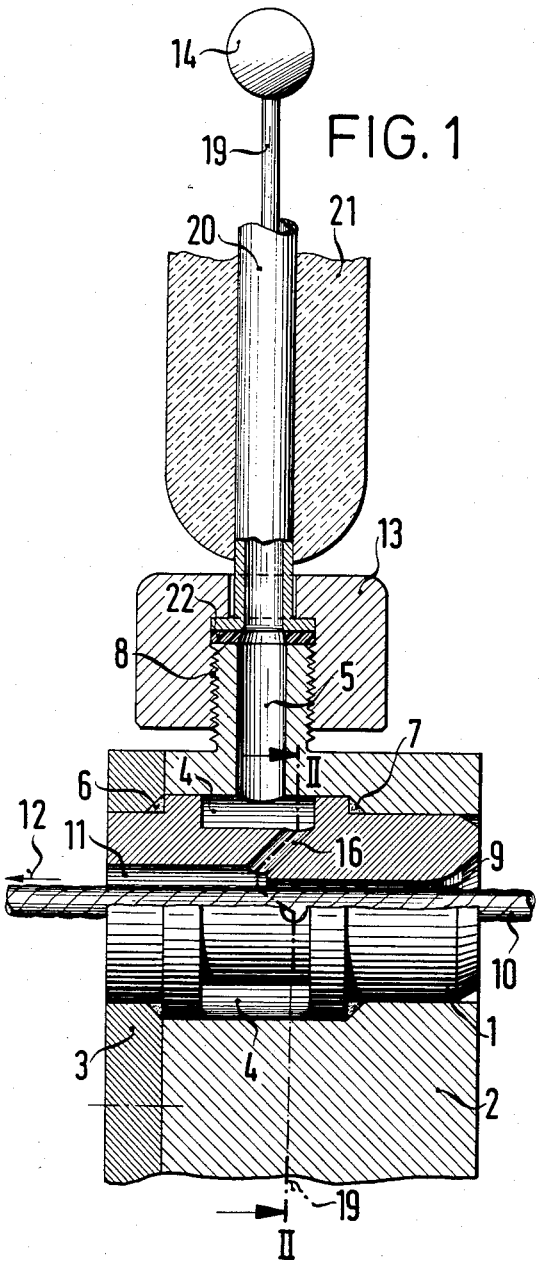
FIG. 1
FIG. 2
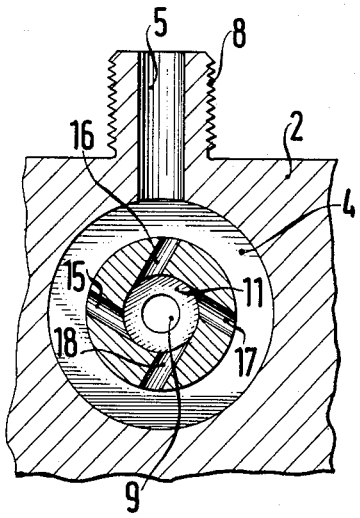

PNEUMATIC SPINNING METHOD AND PNEUMATIC SPINNING DEVICE

The invention relates to a pneumatic spinning method, wherein a sliver formed at least partly of spinning fibers, is conducted through at least one spin effect or swirl nozzle, and the sliver is brought in contact with at least one compressed air jet in the swirl nozzle. The invention also relates to a pneumatic spinning device for performing the method.

Methods and devices of this type have a rather slow production rate and produce a product of low quality.

It is accordingly an object of the invention to provide a pneumatic spinning method and a pneumatic spinning device which overcomes the hereinafore-mentioned disadvantages of the heretoforeknown devices of this general type, and to do so in such a way that the production rate can be increased, while the quality of the thread or yarn produced is improved at the same time.

With the foregoing and other objects in view there is provided, in accordance with the invention, a pneumatic spinning method, which comprises conducting sliver formed at least partly of spinning fibers through at least one swirl or spineffect nozzle, and contacting the sliver in the swirl nozzle with at least one heated compressed air stream or jet operating the swirl nozzle.

The fiber material is warmed by the heated air for a short time and is made pliable for the formation of the thread, without causing excessive drying or embrittlement during this short time.

In accordance with another mode of the invention, there is provided a method of heating the air jet to a temperature of at least 45° C., or at most 120° C., or especially between 60° C. and 80° C. This defines the preferred temperature ranges. In order to obtain the best results, the air temperature is varied depending on the chosen air pressure, the type of swirl nozzle, the spinning speed, the diameter of the sliver, and most of all on the fiber material. Natural fibers with a cellulose base generally withstand higher temperatures than wool fibers or synthetic fibers.

The intention of the steps taken according to the invention is to apply a twisting action to the sliver in a hot air stream, so that the outer fibers wind themselves well around the core fibers in a pliable manner, thus producing a thread or yarn of high quality.

In order to carry out the method, there is provided a pneumatic spinning device, comprising at least one swirl or spineffect nozzle through which sliver formed at least partly of spinning fibers is conducted, a compressed air inlet conducting at least one compressed air stream or jet to the swirl nozzle for acting on the sliver, and a hot air generator connected to the compressed air inlet.

In accordance with a further feature of the invention, the hot air generator is an air compressor. This is done in order to save energy or to utilize energy which would be lost otherwise.

As is well known, an air compressor heats the air by compression, while generating compressed air. In accordance with a concomitant feature of the invention, there is provided an operative or functional connection in the form of a heat-insulated line connected between the hot air generator and the compressed air inlet. In this way, the air which was heated solely by compression to a sufficient degree, is conducted to the swirl nozzle with a minimum of heat loss.

Other features which are considered as characteristic for the invention are set forth in the appended claims.

Although the invention is illustrated and described herein as embodied in a pneumatic spinning method and pneumatic spinning device, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which:

FIG. 1 is a fragmentary, diagrammatic, longitudinal-sectional view of a pneumatic spinning device according to the invention, with a spineffect or swirl nozzle partly cut open;

FIG. 2 is a cross-sectional view taken along the line II—II in FIG. 1, in the direction of the arrows;

Figure 3:
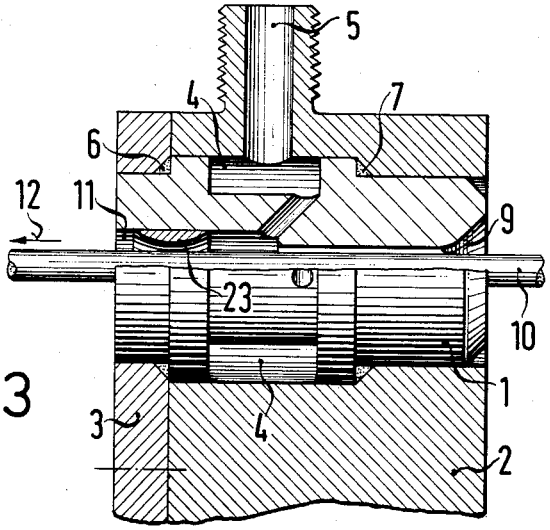
FIG. 3 is a view similar to the lower portion of FIG. 1, showing a somewhat different construction of the swirling, spineffect or whirling nozzle.

Referring now to the figures of the drawings in detail and first, particularly, to FIGS. 1 and 2 thereof, there is seen a spineffect or swirl nozzle 1 disposed in a housing 2 which is covered by a lid 3. An outer ring groove 4 which extends around the spineffect or whirling nozzle 1 is connected to a compressed air inlet 5. Annular seals 6, 7 prevent the escape of the compressed air in the ring groove 4 to the outside.

The swirling nozzle 1 is produced on a lathe and is therefore a round body. As seen in a thread travel direction 12, a central thread channel 9 with a relatively smaller cross section which permits the passage of a sliver 10, is followed by a channel 11 which has a relatively larger cross section.

According to FIG. 2, four injector-air nozzles 15, 16, 17, 18 lead from the ring groove 4 and discharge tangentially but with an axial component, into the channel 11.

The compressed air inlet 5 is provided with a thread 8 which mates with the thread of a retaining or coupling nut 13. A functional or operative connection 19 leads from the compressed air inlet 5 to a hot air generator 14 in the form of an air compressor. The functional or operative connection 19 is flanged to a tube line 20 at the end thereof which is heat-insulated by an insulating shell 21. The flange position of the tube 20 is connected to the compressed air inlet 5 by means of the retaining nut 13 with interposition of a sealing ring 22. A control valve can also be included in the functional or operative connection 19.

While the sliver 10 is rapidly moved or pulled through the swirl nozzle 1 in thread travel direction 12, heat generated in the compressor 14 with a temperature of 60° to 80° C. measured in the ring groove, reaches the sliver through the injector-air nozzles 15–18, so that air turbulence forms in the channel 11 which causes a pneumatically spun thread to be generated from the sliver. FIG. 1 indicates that after leaving the channel 11, outer fibers are wound like a helix around the core fibers of the sliver 10.

In the embodiment according to FIG. 3, a nozzle 23 which creates a narrow section is inserted into the channel 11 of the swirl nozzle 1.

Figure 4:
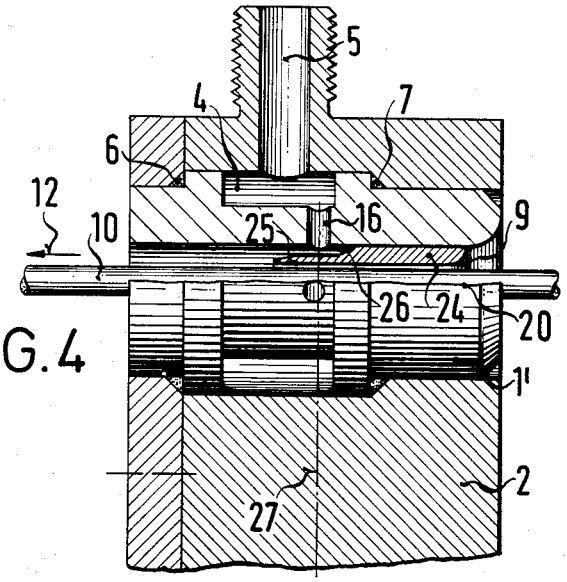
FIG. 4 is another view similar to the lower portion of FIG. 1, showing a further embodiment of a spineffect nozzle.

In the construction of the swirl nozzle 1 according to FIG. 4, the thread channel 9 is disposed in an insert 24. As seen along the travel direction of the thread, the insert 24 has a neck portion 25 so that an annular pre-expansion chamber 26 is formed. In this case the injector-air nozzles 16 discharge tangentially into the pre-expansion chamber 26, and all of the nozzles lie in a plane 27. In all other aspects, this swirl nozzle is constructed the same way as the swirl nozzle according to FIG. 1.

The invention is not limited to the illustrated and described specific embodiments which were used as examples.

I claim:

1. Pneumatic spinning method, which comprises conducting sliver formed at least partly of spinning fibers through at least one swirl nozzle, contacting the sliver in the swirl nozzle with at least one heated compressed air jet operating the swirl nozzle, and imparting a twist to the fibers in the swirl nozzle with at least one heated compressed air jet.

2. Pneumatic spinning method according to claim 1, which comprises heating the air jet to a temperature of at least 45° C.

3. Pneumatic spinning method according to claim 1, which comprises heating the air jet to a temperature of at most 120° C.

4. Pneumatic spinning method accoding to claim 1, which comprises heating the air jet to a temperature of between 60° and 80° C.

5. Pneumatic spinning device, comprising at least one swirl nozzle through which sliver formed at least partly of spinning fibers is conducted, a compressed air inlet conducting at least one compressed air jet to said swirl nozzle for acting on the sliver, and a hot air generator connected to said compressed air inlet, said at least one swirl nozzle including means for imparting a twist to the fibers in said swirl nozzle with at least one compressed air jet.

6. Pneumatic spinning device according to claim 5, wherein said hot air generator is an air compressor.

7. Pneumatic spinning device according to claim 5, including an operative connection in the form of a heat-insulated tube line connected between said hot air generator and said compressed air inlet.

8. Pneumatic spinning device according to claim 6, including an operative connection in the form of a heat-insulated tube line connected between said hot air generator and said compressed air inlet.

* * * * *